United States Patent [19]

Nakamura

[11] 4,197,604

[45] Apr. 15, 1980

[54] BI-MODAL PILLOW

[76] Inventor: Marianne Nakamura, 7220 Fay Ave., La Jolla, Calif. 92037

[21] Appl. No.: 2,952

[22] Filed: Jan. 12, 1979

[51] Int. Cl.[2] ..... A47G 9/00

[52] U.S. Cl. ..... 5/437; 46/116; 46/163; D6/203; D21/153

[58] Field of Search ..... 5/334, 336, 337, 340, 5/341, 446, 447, 490, 431, 434–446; D6/201–204, 153; 46/116, 163

[56] References Cited

U.S. PATENT DOCUMENTS

| | | | |
|---|---|---|---|
| D. 160,223 | 9/1950 | Smith | D6/203 |
| D. 174,996 | 6/1955 | Peters | D6/203 |
| D. 205,881 | 10/1966 | Clayton | D6/203 |
| 2,409,820 | 10/1946 | Zimmern | 215/12 R |
| 2,961,668 | 11/1960 | Hayes | 5/337 |
| 3,961,398 | 6/1976 | Herterich et al. | 24/204 |

FOREIGN PATENT DOCUMENTS

| | | | |
|---|---|---|---|
| 1384835 | 2/1975 | United Kingdom | 46/116 |

*Primary Examiner*—Alexander Grosz
*Attorney, Agent, or Firm*—Ralph S. Branscomb

[57] ABSTRACT

A pillow or cushion is provided having an outer fabric sheath stuffed with resilient wadding such that the pillow is extended in an outstretched position in its first mode, therebeing hands with finger-like projections at the outer ends of the pillow which can interlock to form a closed loop in the second mode of the pillow.

2 Claims, 5 Drawing Figures

BI-MODAL PILLOW

BACKGROUND AND SUMMARY OF THE INVENTION

The invention is a fanciful pillow defining over conventional pillows and cushions in that it has two distinct modes of deployment. The body of the pillow is elongated and will remain in this state under normal conditions because the fabric sheath is stuffed with a resilient wadding such as light weight polyester and thus the unit is biased into a linear mode. In this mode the cushion can be used as a pillow or as an elbow rest or in any other fashion desired.

The pillow has a second mode wherein hands at the outer ends of the pillow are clasped to engage the fingers thereof, these fingers being shaped and dimensioned to interlock and retain the hands together frictionally against the outward bias resulting from the resilient stuffing. In this mode the pillow is usable around the neck of the user, and can be put around the arm as well and even around the waist of a young user. In addition to its use as a cushion in its second mode, others come to mind such as an insulator for a cold drink, and for defining an enclosure on the floor for a child's play toy.

DETAILED DESCRIPTION OF THE PREFERRED EMBODIMENT

Figure 1:
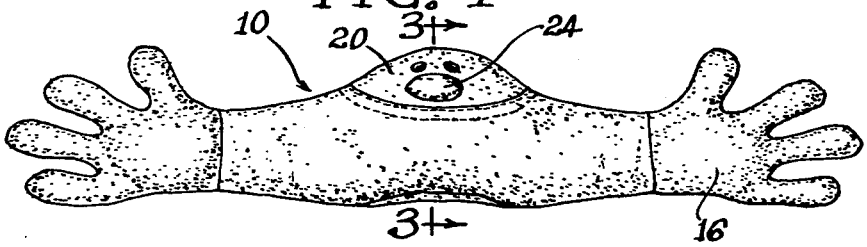
FIG. 1 is a front elevation view of the pillow.
Figure 2:
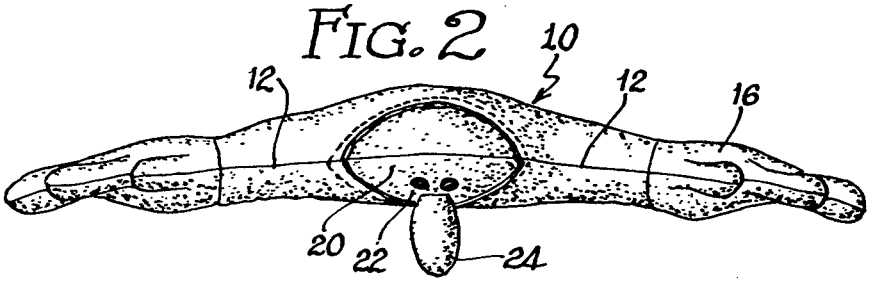
FIG. 2 is a top elevation view of the pillow.
Figure 3:
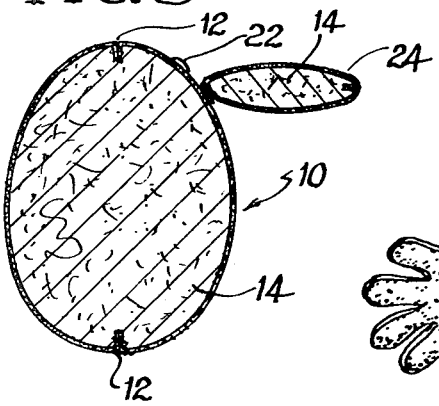
FIG. 3 is a section taken along line 3—3 of FIG. 1.
Figure 4:
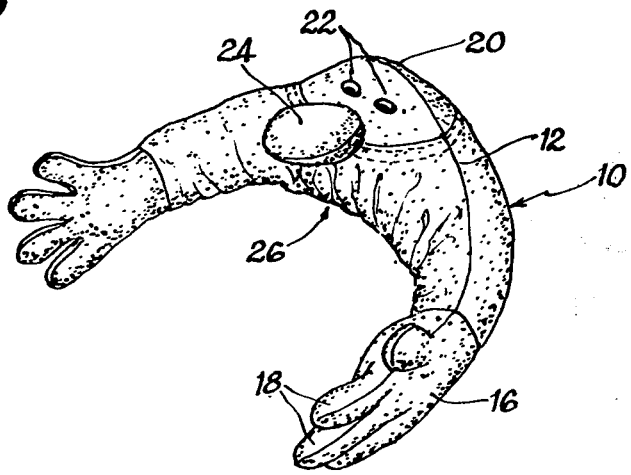
FIG. 4 is a perspective view of the pillow in a partially closed disposition.

The invention has an outer sheath 10 ordinarily sown from several pieces of flannel or other fabric into substantially identical front and rear halves joined along a continuous seam 12. This seam is sown inside out except for a small area in the central bottom which is left open and stuffed with a resilient, light-weight wadding material 14. This material could be anything that is suitably resilient and light-weight. Unwoven polyester fibers have proven ideal for this purpose. The polyester packing when appropriately done causes the pillow to extend into that shape shown in FIGS. 1 and 2 when in a normal mode not subject to outside stresses or pressures.

Figure 5:
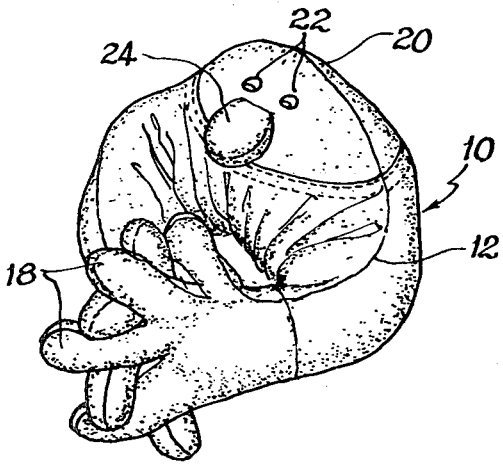
FIG. 5 is a perspective view of the pillow in its closed-up clasped mode.

The ends of the pillow are provided with hands 16. These hands could be replaced with feet, or other fanciful members suggestive of animal paws, etc., provided they include extending digits 18 which are capable of interlocking as shown in FIG. 5 to retain the ends of the pillow in a clasped relation. This can be achieved strictly with friction by forcing the fingers together, or the fingers can be slightly bulbous at the ends so that a a positive interlocking effect is achieved.

The pillow ideally is thickened in its central portion and may be raised as at 20 and having indicia 22 which can be printing, bottons or other structure suggestive of a face. In addition, a floppy nose 24 adds not only to the aesthetics of the pillow but also covers folds 26 so that the pillow is more comfortable, particularly used in its closed-loop mode of FIG. 5 around the neck.

The pillow is primarily used as an elbow rest or head cushion when it is extended, and when in its closed-loop position in FIG. 5 provides support for the back of the neck when engaged around the neck reminiscent of oriental neck blocks which individuals use to sleep. In addition to quite a wide variety of miscellaneous uses, the pillow can be fashioned to display a variety of different faces, hand shapes and general overall shapes including one resembling Santa Claus for the Christmas Season. Such aesthetic variations are myriad in addition to the variety of conceivable functions for the pillow.

I claim:

1. A bi-modal pillow comprising:

(a) an elongated resilient body comprising a hollow flexible sheath made resilient by being packed with resilient wadding to springload said body into a naturally outstretched position; and (b) said elongated body having a digit-defining member defined at each end thereof, said digit-defining members each defining a plurality of extending digits enlarged towards the distal ends thereof to permit the interlocking of same against the springloading forces of said resilient wadding to define a closed-loop mode as an alternative to said outstretched position.

2. A bi-modal pillow according to claim 1 wherein the central portion of said body is thickened relative to the end portions to provide an augmented cushioning effect, and said thickened portion displays indicia representative of a face and including a depending flap serving as a nose for said face and as a smooth cover for bunched portions of said sheath when said pillow is in its closed-loop mode.

* * * * *